United States Patent [19]

Latham

[11] 4,437,426

[45] Mar. 20, 1984

[54] WING TYPE AIR FOIL ASSEMBLY

[75] Inventor: Ronald D. Latham, Apex, N.C.

[73] Assignee: Fiberglass Unlimited, Inc., Durham, N.C.

[21] Appl. No.: 333,025

[22] Filed: Dec. 21, 1981

[51] Int. Cl.[3] ..... B63H 9/04; B64C 9/24

[52] U.S. Cl. ..... 114/103; 114/102; 114/39; 244/123; 244/210; 244/219

[58] Field of Search ..... 114/39, 102, 103; 244/123, 210, 219

[56] References Cited

U.S. PATENT DOCUMENTS

| | | | |
|---|---|---|---|
| 2,077,685 | 4/1937 | Gerhardt | 244/219 |
| 2,319,999 | 5/1943 | Jennings | 114/102 |
| 3,987,984 | 10/1976 | Fischer | 244/219 |
| 4,164,909 | 8/1979 | Ballard | 114/39 |
| 4,369,724 | 1/1983 | Weiss | 114/103 |

FOREIGN PATENT DOCUMENTS

| | | | |
|---|---|---|---|
| 2144573 | 4/1973 | Fed. Rep. of Germany | 114/103 |
| 198649 | 5/1924 | United Kingdom | 114/39 |
| 568209 | 3/1945 | United Kingdom | 114/103 |
| 1406240 | 9/1975 | United Kingdom | 244/219 |

*Primary Examiner*—Trygve M. Blix
*Assistant Examiner*—Rodney Corl
*Attorney, Agent, or Firm*—Mills and Coats

[57] ABSTRACT

The present invention relates to a wing type air foil assembly that is adapted to be utilized by boats or vessels, or even vehicles, that is designed to function in the same general manner as a wind sail for providing driving thrust to the vessel or vehicle. In the case of a vessel, the wing type air foil is rotatively mounted about a generally vertical axis and includes a central spar journaled about a holding shaft extending upwardly from a pylon supported by the vessel. Provided about the upper end of the spar is a tip member while a root member is provided about the lower portion of the spar. Extending around and between the root and tip members is a flexible line that includes a forward run that forms a part of the leading edge of the wing type air foil assembly and a rear run that also extends between the tip and root members that forms a part of the trailing edge of the entire air foil assembly. A wing portion is formed by providing a skin covering that extends from the rear run of the flexible line member to and around the spar and back to the rear run to form a two-sided variable camber wing. An elongated slat is secured to the forward run of the flexible line member and is pivotably mounted thereto. The slat extends from the forward run of the flexible line member rearwardly toward the spar and includes a trailing edge that is generally maintained in spaced apart relationship with respect to the spar so as to define a slotted area therebetween.

9 Claims, 3 Drawing Figures

SECTION A-A

WING TYPE AIR FOIL ASSEMBLY

FIELD OF INVENTION

The present invention relates to sailing crafts and structures that utilize wind energy for propulsive force, and more particularly to a wing type air foil that may be utilized to drive a vessel, vehicle or the like.

BACKGROUND OF INVENTION

Although the appearance of the conventional sail is quite different from that of an aircraft wing, its function in generating a positive force is based on the same aerodynamic principles as the wing. Parenthetically, it should be noted that in referring to positive force when comparing a wing to a sail, one is referring to "lift" in a wing and "thrust" in a sail. The sail, however, is considerably the less productive of the two. This is partly because the sail utilizes a single surface air foil as opposed to the more efficient double surface air foil of the wing.

Another factor that reduces the efficiency of a conventional sail is its external bracing, mast and rigging, which disturbs the flow of air around its surface, resulting in an energy loss to turbulence and drag.

Inspite of its much greater efficiency, a standard wing does not make a good sail when mounted in a vertical position so that the lift that it generates can be used as thrust to drive a boat or vehicle. This is because of the shape of the wing and the fact that in use wind is directed against both sides of the wing at various angles. In this regard, it should be appreciated as the wind approaches a conventional wing at a positive angle of attack from what was its bottom surface, the wing will produce good results and significantly improve the efficiency over the conventional sail. But when the wind is directed from a direction where the same impinges on the upper surface of a conventional wing, its efficiency drops well below that of the sail.

Consequently, it follows that in order to provide an all around efficient wing for "sailing purposes" that it would be desirable to design the same to have a changeable air foil, or variable camber. This would enable the wing to have the high efficiency referred to with the wind approaching the same from either side.

It should be noted that the provision of a variable camber wing for a vessel has been provided in the past. A close review of the prior art in this area reveals that the design and construction of such variable camber wings have been complex and in fact impractical when considered on a commercial production basis.

Because of the increases in efficiency achieved by such a variable camber wing, it is highly desirable that a relatively simple and easy to use design be provided that lends itself to commercial production.

SUMMARY AND OBJECTS OF THE INVENTION

The present invention entails a relatively simple, variable camber wing type air foil for a vessel or the like that because of its design is commercially feasible and well suited for commercial production. Structurally the wing type air foil includes a central load carrying spar that essentially supports the entire air foil and the components thereof. Disposed about opposite ends of the spar is an upper tip member and a lower root member. A flexible line or cable is interconnected in a general loop fashion around and between said tip and root members and includes a forward run spaced forwardly of the spar and a rearward run spaced rearwardly of the spar. Secured to the forward run of the cable is a slat that includes a trailing edge that terminates in spaced apart relationship with the spar so as to define a slot area therebetween. A skin covering extends between said rear run and said spar and is actually wrapped around the spar to create a double surface wing panel with the leading edge thereof being formed by the spar and the trailing edge being formed by the rear run of said flexible line or cable.

The entire air foil assembly is supported by journaling said spar about a holding shaft extending upwardly from a pylon supported by the vessel. Consequently, the entire air foil assembly can be rotated about said holding shaft so as to properly orient the air foil assembly with respect to oncoming wind.

It is, therefore, an object of the present invention to provide a relatively simple variable camber air foil for a vessel or the like that is commercially feasible and well suited for commercial production.

Another object of the present invention resides in the provision of a variable camber air foil for a vessel that is relatively inexpensive and which is affordable to a person of modest income.

Still a further object of the present invention resides in the provision of an air foil of the character referred to hereinabove that can be commercially produced by normal tooling and production techniques.

Another object of the present invention is to provide a variable camber wing type air foil of the character referred to hereinabove that is designed such that the same can be placed, carried on top of an automobile along with a vessel hull.

It is also an object of the present invention to provide a highly efficient wing type air foil for a vessel where the efficiency approached is that of a conventional wing and which considerably improves on the efficiency of a conventional sail.

A further object of the present invention resides in the provision of a wing type air foil of the character referred to above, particularly adapted for use in conjunction with a boat or vessel, which is provided with a strong and durable surface air foil.

Still a further object of the present invention resides in the provision of a wing type air foil of the character referred to above that is completely supported in a cantilevered fashion when mounted to a vessel.

A further object of the present invention resides in the provision of a variable camber wing type air foil wherein the camber is automatically variable.

Another object of the present invention resides in the provision of a variable camber wing type air foil for a vessel wherein the angle of attack of the wind thereon is variable and easily controllable.

It is also an object of the present invention to provide a variable camber wing type air foil assembly for use with a vessel wherein the air foil is functional in all normal sailing wind conditions.

It is also an object of the present invention to provide a wing type air foil assembly for a boat or vessel of the character referred to above that is easily adaptable for use in conjunction with small standard production hulls such as the "Sunfish", "Sail Fish", and "Lazer".

Another object of the present invention resides in the provision of a variable camber wing type air foil assembly for a vessel that is designed to encourage and provide a smooth air flow around the surface of the air foil during unstalled conditions.

More particularly, a further object of the present invention resides in the provision of a wing type air foil assembly of the character referred to above that is adaptable for commercial production and which is relatively simple, includes relatively few parts, designed to be constructed of common materials, and which requires a minimum amount of labor.

A further object of the present invention resides in the provision of a wing type air foil assembly of the character referred to above that is particularly adapted for use in conjunction with a vessel, which minimizes load carrying structural members incorporated into the design.

A further object of the present invention resides in the provision of a wing type air foil of the character referred to hereinabove which is particularly adapted for use in conjunction with a vessel, and which is designed with the complete absence of horizontal rib members extending throughout the body of the air foil assembly itself.

Other objects and advantages of the present invention will become apparent from a study of the following description and the accompanying drawings which are merely illustrative of the present invention.

WING TYPE AIR FOIL

Figure 1:
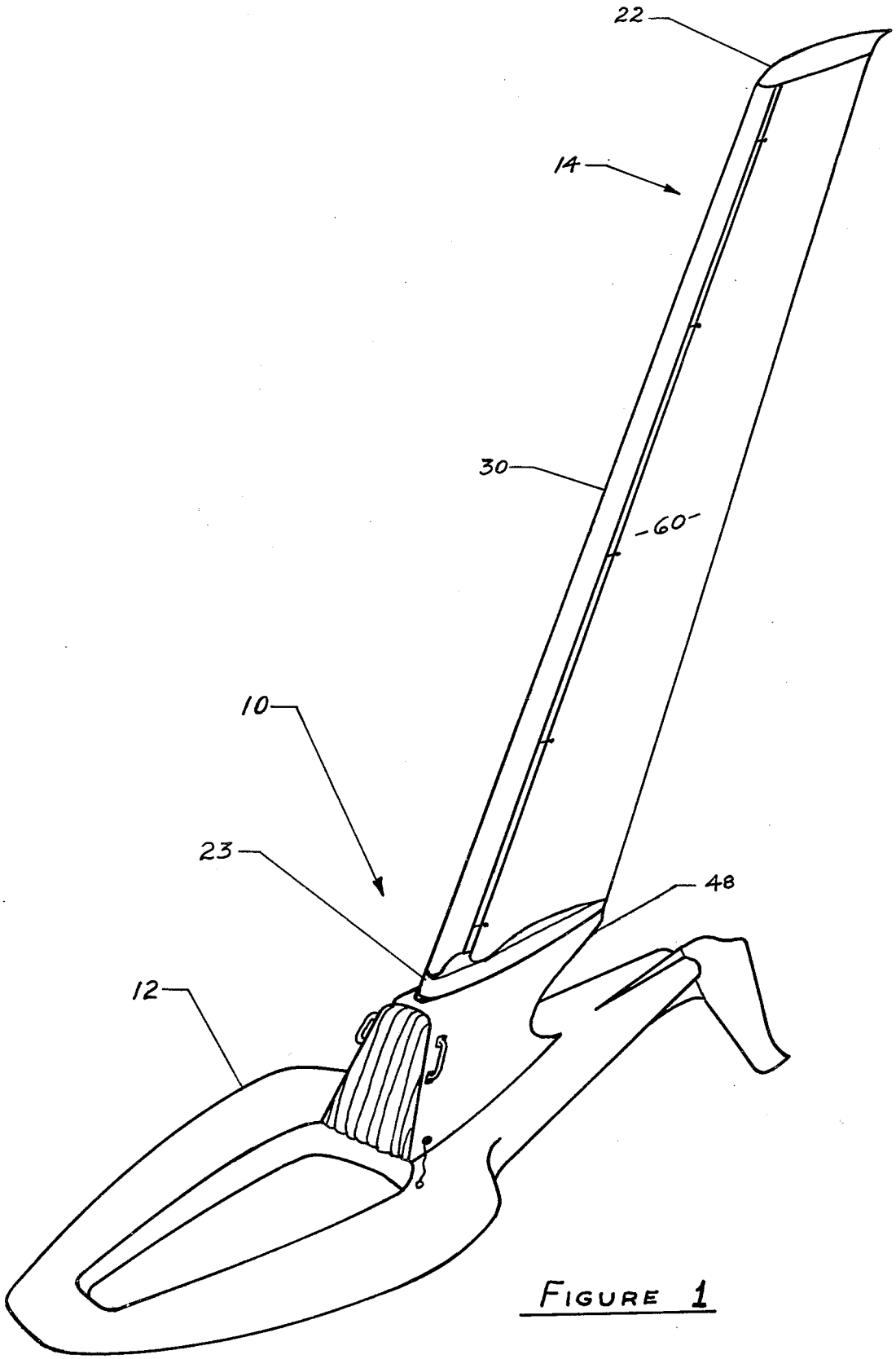
FIG. 1 is a perspective view of a wing type "sail" vessel incorporating the air foil assembly of the present invention.
Figure 2:
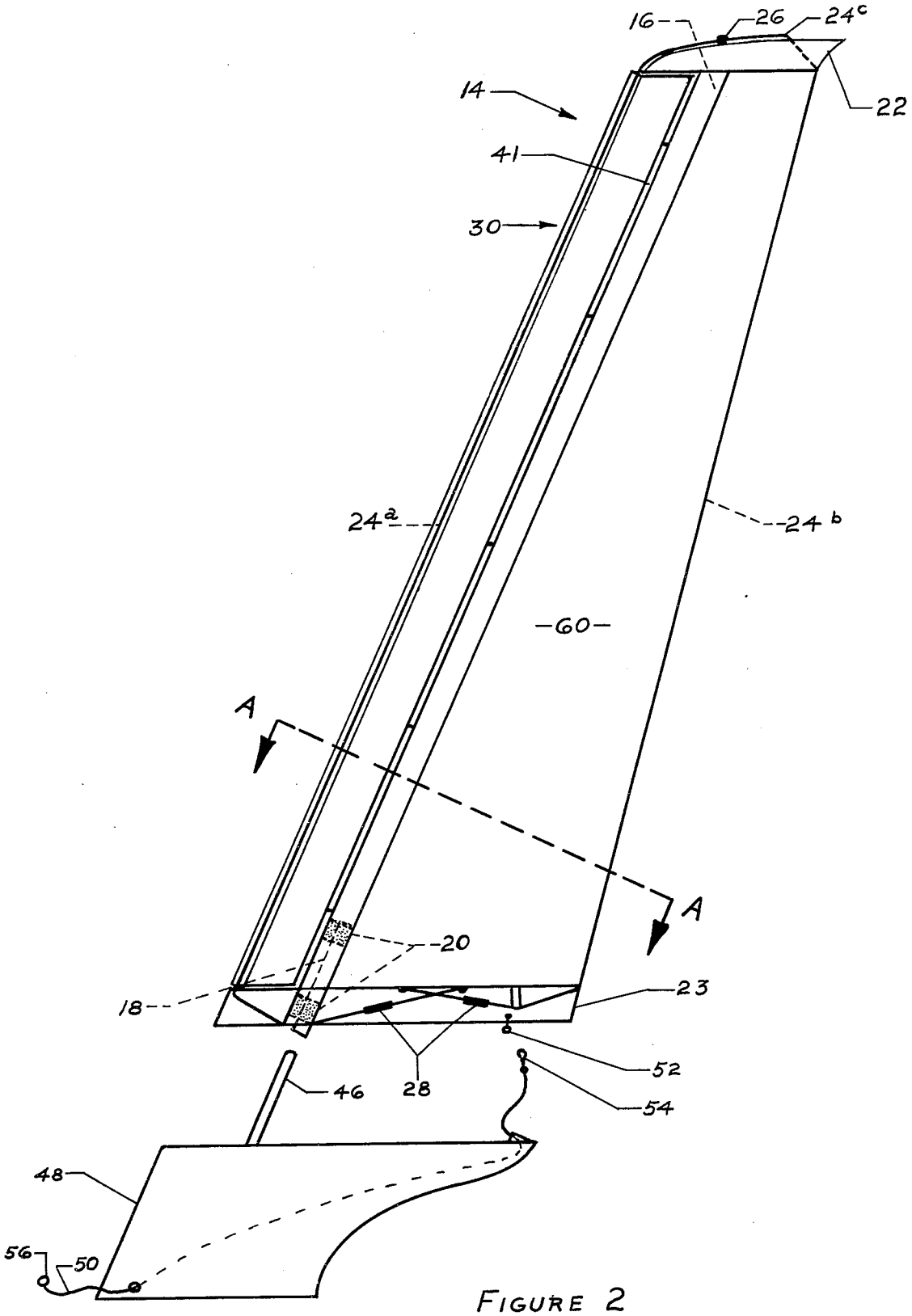
FIG. 2 is a side view of the air foil assembly of the present invention.
Figure 3:
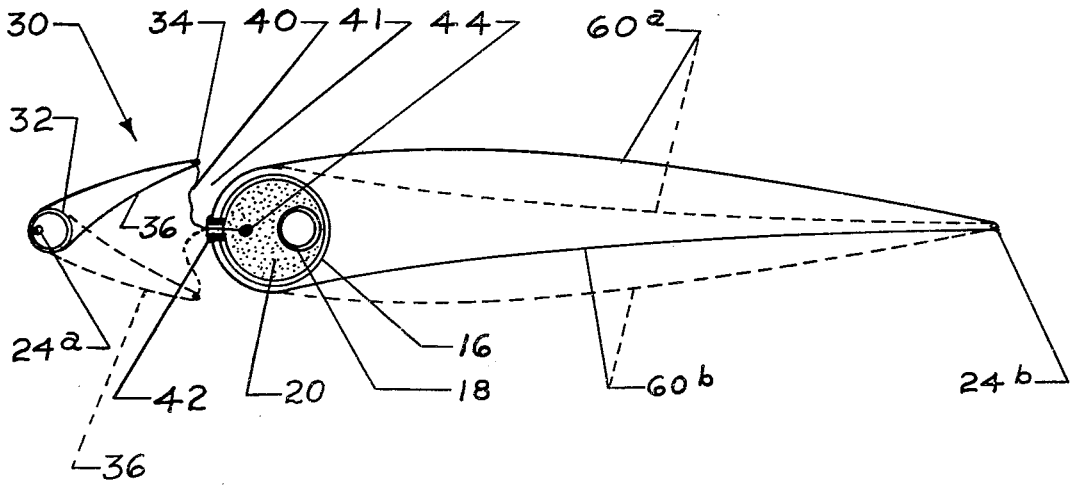
FIG. 3.is a sectional view of the air foil assembly of the present invention taken through lines A—A in FIG. 2.

With further reference to the drawings, the wing type air foil of the present invention is shown therein and in conjunction with a boat or vessel. Accordingly there is shown a wing type "sail" boat indicated generally by the numeral 10. Although the wing type air foil of the present invention could be utilized by vehicles and other devices, in the present disclosure, the same is shown and described in conjunction with a boat or vessel having a hull 12.

Continuing to refer to the wing type "sail" boat 10, it is seen that the same includes a wing type air foil assembly, indicated generally by the numeral 14 that is pivotably mounted about a rear portion of hull 12. Viewing wing type air foil assembly 14, it is seen that the same includes an elongated spar 16. Spar 16 in a typical design embodiment includes a two-inch diameter tube that extends the full length of the air foil assembly 14. Spar 16 is the principal structural member of the air foil assembly 14 and actually supports the remaining structure of the air foil assembly 14.

Secured to a lower end of spar 16 is a tube or socket tube 18. Tube 18 in an illustrated design is made of aluminum and is 1.125 inches in diameter and 10 inches long. Socket tube 18 is disposed inside spar 16 and is securely held therein by two epoxy plugs 20 which are "poured in" after socket tube 18 has been properly positioned inside spar 16.

Secured to a top portion of spar 16 is a tip member 22. In an illustrated design, tip member 22 comprises an elongated wooden structural member with a fiberglass outer shell. While tip member 22 can be secured in various ways to spar 16 in a contemplated design, the same is epoxied onto spar 16.

Secured about the opposite end of spar 16 is a root member 23. Root member 23 is hollow and includes an outer fiberglass shell disposed over a balsa wood core.

Forming a part of the periphery of wing type air foil assembly 14 is a flexible line or cable 24. As seen in the drawings, cable 24 is attached to root member 23 and includes a rear run **24*b* that extends therefrom up to tip member 22. At the tip member 22, there is provided a cable positioning screw 26 that normally positions cable 24 and upper segment 24*c* appropriately about tip member 22 and accordingly it can be stated that cable 24 includes a top segment 24*c* that extends along an adjacent tip member 22. From tip member 22, cable 24 extends downwardly towards root member 23 and this segment of cable 24 is referred to as forward run 24*a*. Both ends of cable 24 are provided with a turn buckle 28 that is in turn operatively connected to root member 23. Turn buckles 28 are utilized to adjust the tension in flexible line or cable 24**.

To form the wing portion of the air foil assembly 14, a skin covering 60 in the form of 0.007 inch mylar extends from the rear run **24*b* of cable 24 to spar 16 where the same is wrapped therearound, and from spar 16 the same extends back to the rear run 24*b* where it is secured. This forms a wing portion that includes two sides 60*a* and 60*b*. The mylar skin is selectively tensioned and sufficiently plyable to yield a variable camber effect such that either side, 60*a* or 60*b*, can be the upper or concave side of the "wing", depending on the direction of the wind. It is thusly appreciated that the mylar skin 60 that forms the wing portion of air foil assembly 14 is essentially supported by spar 16 and the rear run 24*b* of cable 24. This means that there are no transverse or horizontal supports running between the leading and trailing edges of the wing portion between the tip and root members 22 and 23**, respectively.

Mounted forwardly of the wing portion is an elongated slat, indicated generally by the numeral 30. Slat 30 includes an elongated tube 32 that forms the leading edge thereof and an elongated segment of piano wire 34 that forms the trailing edge of the slat. Just as in the case of the wing portion described hereinabove, slat 30 includes a mylar skin 36 that extends from the piano wire 34 to tube 32 and wraps therearound after which the same extends back to the piano wire 34 to form dual variable camber surfaces.

There is provided a plurality of slat ties interconnected between the trailing edge of slat 30 and spar 16. Slat ties 40 are provided to control the size of a defined slot area 41 that exists between the trailing edge of the slat 30 and spar 16.

Spar 16 includes a plurality of openings that are provided with "tie gromets 42". Tie gromets 42 are neoprene and are inserted into the openings of the main spar 16 to prevent the slat ties 40 from abraiding against the spar 16.

In addition, each slat tie 40 includes an enlarged tie end 44 that prevents the same from inadvertently slipping through the opening formed within spar 16.

In the case of the use of the air foil assembly 14 with a boat hull 12, to support the air foil assembly 14, there is provided a pylon 48 secured to the hull 12 which includes a spar holding shaft or tang 46 extending therefrom. It is appreciated that the socket tube 18 disposed about the lower portion of spar 16 is adapted to be inserted over holding shaft 46 such that spar 16 and the entire air foil assembly 14 may be rotated about the axis of the holding shaft 46.

To control the hull 12 and air foil assembly 14, there is provided a sheet line 50. Sheet line 50 is provided with a quick connect coupler 54 that is adapted to attach to an attaching point 52 provided about root member 23. Sheet line 50 further includes a ball head 56 secured to the remote end that is adapted to be gripped by an individual. Consequently, it is appreciated that by pulling and releasing sheet line 50, that the entire air foil assembly 14 can be appropriately rotated about holding shaft 46.

In a contemplated design, air foil assembly 14 would preferably be disposed at a twenty-five degree sweep back angle. That is, in a normal upright position, the spar 16 would be disposed at a twenty-five degree angle with respect to a true normally extending vertical line. Again, it is appreciated that the mylar skin 60 is selectively disposed and tensioned such that the wing portion includes a variable camber capability. As illustrated in the drawings, this means that either side of the wing, 60*a* or 60*b*, can assume a concave or upper aircraft wing profile depending upon the direction of the wind.

In addition the full span slat produces a slot effect that results in the delay of a "stall" condition and also improves high angle of attack performance. Also the slat aids in the maintenance of smooth air flow around the surface of the camber side of the wing panel during all unstalled conditions.

It is appreciated that the size and orientation of the air foil assembly 14 can be varied in accordance with desired specifications and performances. In a prototype design, the air foil assembly was ten feet tall with an average cord length of twenty-one inches, without the slat 30. This represents an aspect ratio of 11.43:1 in aircraft terms and a total area, including the slat, of approximately 22.5 square feet. This complete system is light and may be detached from a hull and slipped into a sheath and placed on the top of an automobile, with its hull, by one person of modest strength. It has been found that in certain designs that the total weight of the air foil assembly and a hull can be less than 50 pounds.

From the foregoing specification and description, it is appreciated that the present invention entails an air foil assembly, particularly adapted to be used in conjunction with the hull of a vessel for "sailing purposes", that is relatively simple, light weight, easy to use, and perhaps most important, suited for commercial production and affordable in comparison to similar size "sailing devices".

The present invention, of course, may be carried out in other specific ways than those herein set forth without departing from the spirit and essential characteristics of the invention. The present embodiments are, therefore, to be considered in all respects as illustrative and not restrictive, and all changes coming within the meaning and equivalency range of the appended claims are intended to be embraced therein.

What is claimed is:

1. A relatively simple and effective wing type air foil for a vessel that utilizes wind to drive the same, comprising: a wing type air foil assembly including an elongated spar; a tip member secured about a top portion of said spar; a root member secured to a lower portion of said spar and spaced from said tip member; flexible line member means secured to and between said root member and said tip member for supporting and stabilizing said spar, said flexible line member means including opposite and counteracting forward and rear runs with said forward run being spaced forwardly of said spar and the rear run spaced rearwardly of said spar and wherein said forward and rear runs extend between said tip and root member and cooperate to structurally support and stabilize said spar such that opposite and counteracting forces provided by the forward and rear runs relative to the spar maintains the spar erect and prevents the spar from significantly bending or from developing and "S" curve shape; a skin covering operatively interconnected between said spar and said rear run of said flexible line member means and including first and second opposite sides that effectively form a variable camber wing air foil with leading and trailing edges; a slat disposed externally of and adjacent to the leading edge of said variable camber wing air foil and movably mounted on the forward run of said flexible line member means, said slat having a trailing edge normally spaced from said spar for defining slot means therebetween for effectively increasing the lift and consequently the thrust of said wing type air foil assembly, said slot means functioning to direct a relatively high speed flow of air through said slot means for meeting and joining a system of air passing over the upper surface of the variable camber wing air foil for effectively increasing the speed of the flow of air passing over the upper surface of said variable camber wing air foil resulting in the air flow passing across the upper surface of the variable camber wing air foil remaining in contact therewith over a greater portion of the upper surface of the variable camber wing air foil whereby by delaying the time that the passing air separates from contact with the upper surface of said variable camber wing air foil results in the wing type air foil assembly experiencing greater lift and thrust; mounting means for movably mounting said spar and the wing type air foil assembly to said vessel; and control means operatively connected to said wing type air foil assembly for enabling the same to be moved relative to said vessel for enabling the wing type air foil assembly to be selectively oriented with respect to the directions of the wind.

2. The vessel wing type air foil of claim 1 wherein said mounting means includes a pylon secured to said vessel and a holding shaft extending upwardly therefrom; and wherein said lower end of said spar is provided with receiver means for receiving said holding shaft such that said spar can be effectively supported and rotated about said holding shaft.

3. The vessel wing type air foil of claim 2 further including tension adjustment means operatively connected to said flexible line member for adjusting the tension thereof.

4. The vessel wing type air foil of claim 3 wherein said control means includes a flexible line communicatively connected to said wing type air foil assembly at a point spaced from said spar, whereby said wing type air foil assembly can be moved with respect to said vessel by pulling said flexible line.

5. The vessel wing type air foil assembly of claim 3 wherein said tension adjustment means includes a pair of turn buckles disposed about said root member of said air foil assembly, with each turn buckle being operatively connected to the respective forward and rear runs of said flexible line member.

6. The vessel wing type air foil of claim 1 wherein said slat includes an elongated conduit that forms a part of its leading edge and wherein said forward run of said flexible line member extends through said conduit thereby effectively securing said slat to said wing type air foil assembly.

7. The vessel wing type air foil of claim 6 wherein said flexible line member includes an upper segment that extends along said tip member between said forward and rear runs.

8. The vessel wing type air foil of claim 7 wherein said spar and slat are generally disposed in parallel relationship such that the slot area defined between said spar and the trailing edge of said slat is of a generally uniform width from one end of the wing type air foil assembly to the other.

9. The vessel wing type air foil of claims 1 or 6 wherein the trailing edge of said slat includes a flexible line and wherein there is provided a skin covering about said slat that extends from said flexible line to said conduit and from said conduit back to said flexible line to form a two-sided variable camber slat surface.

* * * * *

UNITED STATES PATENT AND TRADEMARK OFFICE

CERTIFICATE OF CORRECTION

PATENT NO. : 4,437,426

DATED : March 20, 1984

INVENTOR(S) : Ronald D. Latham

It is certified that error appears in the above-identified patent and that said Letters Patent is hereby corrected as shown below:

On the title page of the patent, delete:

"[73] Assignee: Fiberglass Unlimited, Inc., Durham, N.C."

Signed and Sealed this

Sixteenth Day of August, 1988

*Attest:*

DONALD J. QUIGG

*Attesting Officer*

*Commissioner of Patents and Trademarks*